US006770850B2

(12) United States Patent
Taniguchi et al.

(10) Patent No.: US 6,770,850 B2
(45) Date of Patent: Aug. 3, 2004

(54) HEATER

(75) Inventors: Masato Taniguchi, Aichi (JP); Katsuhiko Tanaka, Aichi (JP); Masakazu Nagasawa, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 10/207,835

(22) Filed: Jul. 31, 2002

(65) Prior Publication Data

US 2003/0029857 A1 Feb. 13, 2003

(30) Foreign Application Priority Data

Aug. 10, 2001 (JP) ..... 2001-243191

(51) Int. Cl.[7] ..... F23Q 7/00
(52) U.S. Cl. ..... 219/270; 313/145; 219/541
(58) Field of Search ..... 219/270, 541; 123/145 A; 313/143, 145; 439/125, 127, 128, 890

(56) References Cited

U.S. PATENT DOCUMENTS 4,563,568 A * 1/1986 Takizawa ..... 219/270
4,758,189 A * 7/1988 Draxler ..... 439/848
4,770,642 A * 9/1988 Van Hoose ..... 439/127
4,806,734 A * 2/1989 Masaka et al. ..... 219/270
4,810,853 A * 3/1989 Maruta et al. ..... 219/270
5,206,484 A * 4/1993 Issartel ..... 219/270
5,362,944 A * 11/1994 Hatanak et al. ..... 219/270
5,630,722 A * 5/1997 Mochizuki et al. ..... 439/125
5,716,223 A * 2/1998 Phillips et al. ..... 439/125
5,852,280 A * 12/1998 Mizuno ..... 219/270
5,883,561 A * 3/1999 Nakamura et al. ..... 337/198
6,137,211 A * 10/2000 Sugimoto et al. ..... 313/145
6,280,210 B1 * 8/2001 Sikora et al. ..... 439/127
6,302,712 B1 * 10/2001 Delsole ..... 439/125
6,358,071 B1 * 3/2002 Moga ..... 439/125
6,437,492 B1 * 8/2002 Geissinger et al. ..... 313/318
6,475,002 B2 * 11/2002 Delsole ..... 439/127
6,583,539 B1 * 6/2003 Zamora ..... 313/143
2002/0162834 A1 * 11/2002 Asano et al. ..... 219/541

* cited by examiner

*Primary Examiner*—Denise Pothier
*Assistant Examiner*—L Fastovsky
(74) *Attorney, Agent, or Firm*—Sughrue Mion, PLLC

(57) ABSTRACT

A heater has a cylindrical metallic shell, a heater body partly disposed in a front end portion of the metallic shell, an electrode disposed in a rear portion of the metallic shell and electrically connected to the heater body, and a terminal adapted to be capped with an electric connector. The terminal includes a terminal body for power supply to the heater body through the electrode and an engaging portion formed on an outer circumferential surface of the terminal body so as to be engageable with the electric connector. The electrode and the terminal body are formed integrally with each other. Such a heater can maintain good electrical conduction from the terminal to the heater body with its simple structure throughout an extended period of time.

6 Claims, 5 Drawing Sheets

HEATER

BACKGROUND OF THE INVENTION

The present invention relates to a heater, such as a ceramic heater or a sheath heater, particularly of the kind suitable for a glow plug and an engine coolant heating device.

Hereinafter, the term "front" refers to a heating end side with respect to the axial direction of a heater, and the term "rear" refers to a side opposite the front side.

A glow plug is mounted in the cylinder head of a diesel engine for attaining a rapid starting of the engine. The glow plug includes a heater generally provided with a cylindrical metallic shell, a rod-shaped heater body disposed in a front portion of the metallic shell with a front end portion of the heater body protruded from the metallic shell and an electrode disposed in a rear portion of the metallic shell for power supply to the heater body. The heater body and the electrode are positioned so as to provide a space between a rear end surface of the heater body and a front end surface of the electrode, and a front end portion of the electrode is electrically connected to a rear end portion of the heater body via a metallic lead wire. Further, a rear end portion of the electrode is protruded from the metallic shell. A terminal member is fitted onto the protruded rear end portion of the electrode by e.g. caulking so as to be detachably capped with a connector with a harness. In such a structure, the heater body is externally energized through the connector, the terminal member, the electrode and the lead wire.

SUMMARY OF THE INVENTION

It is now noted that the heater requires good electrical conductivity from the terminal member to the heater body for the purpose of improving the heat generating efficiency of the heater.

However, the electrical connection between the electrode and the terminal member is attained by caulking the terminal member to the electrode in the above structure, and such caulked portions are rust-prone to increase a contact resistance in the connection between the electrode and the terminal member over time. Thus, there often arise problems of high power loss and undesired heat generation at such a connection. Further, the terminal member needs to have a particular configuration for mating and unmating with the connector, and be knurled to strengthen the connection between the terminal member and the electrode. As a result, much time and effort are required for the production of the heater, which results in increase in production cost It is therefore an object of the present invention to provide a heater which can be easily produced with a simple structure and attain good electrical conduction from the terminal member to the heater body throughout an extended period of time. Particularly, such a heater can be embodied as a ceramic heater in which a heating element is embedded in a ceramic substrate or a sheath heater in which a heating element is accommodated in a metallic sheath tube, which are suitable for a glow plug and an engine coolant heating device.

According to a first aspect of the present invention, there is provided a heater comprising: a cylindrical metallic shell; a heater body partly disposed in a front end portion of the metallic shell; an electrode disposed in a rear portion of the metallic shell and electrically connected to the heater body; and a terminal adapted to be capped with an electric connector, the terminal having a terminal body to be directly brought into electrical connection with the electric connector for power supply to the heater body through the electrode and an engaging portion formed on an outer circumferential surface of the terminal body so as to be engageable with the electric connector, the electrode and the terminal body being formed integrally with each other.

According to a second aspect of the present invention, there is provided a heater comprising: a metallic shell; a heater body partly disposed in a front end portion of the metallic shell; a conductive rod disposed in a rear portion of the metallic shell such that a rear end portion of the conductive rod is protruded from the metallic shell, the conductive rod being a single piece and electrically connected at a front end portion thereof to the heater body for power supply to the heater body; and an engagement protrusion formed radially outward on an outer circumferential surface of the protruded rear end portion of the conducting rod so as to be engageable with an electric connector and thereby make a direct electrical connection between the conductive rod and the electric connector.

DESCRIPTION OF THE EMBODIMENTS

Figure 1:
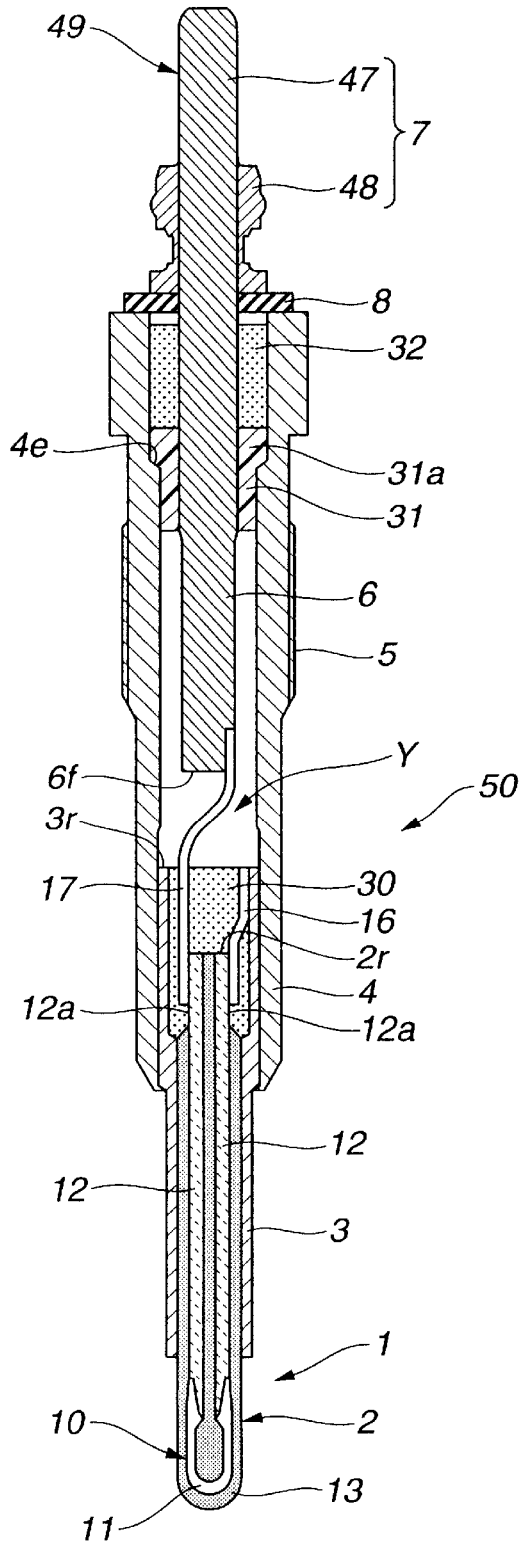
FIG. 1 is a sectional view of a heater embodied as a ceramic heater for a glow plug according to a first embodiment of the present invention.

Hereinafter, an explanation will be given of a heater according to the present invention by way of preferred embodiments. Like parts and portions in the following embodiments are designated by like reference numerals, and repeated descriptions thereof are omitted.

Firstly, a glow plug 50 according to a first embodiment of the present invention will be described with reference to FIGS. 1, 2A, 2B and 3.

Figure 2A:
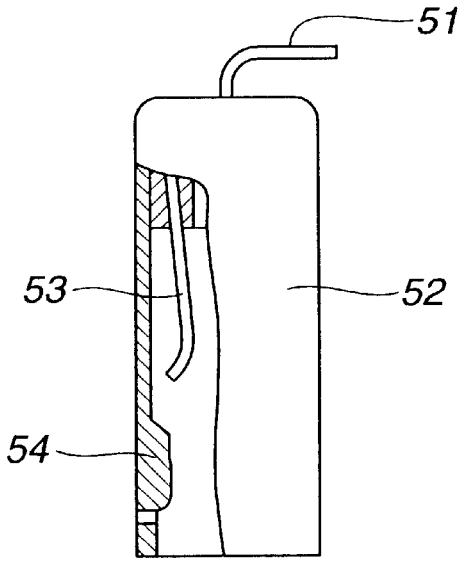
FIG. 2A is a partially sectional view of a connector for the heater of FIG. 1
Figure 2B:
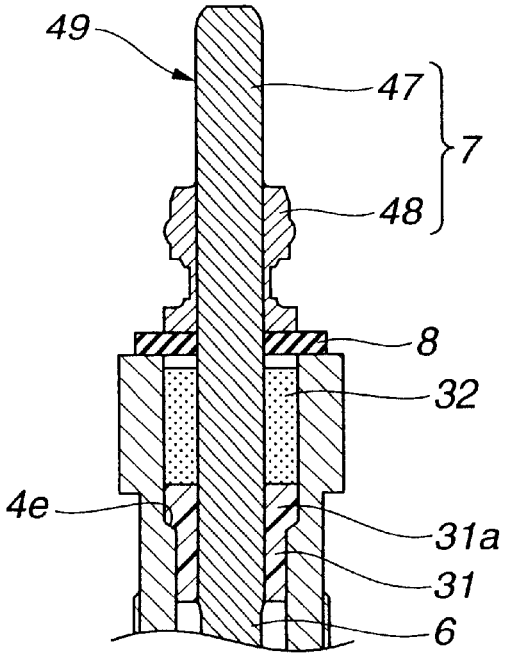
FIG. 2B is a sectional view of a rear end portion of the heater of FIG. 1.
Figure 3:
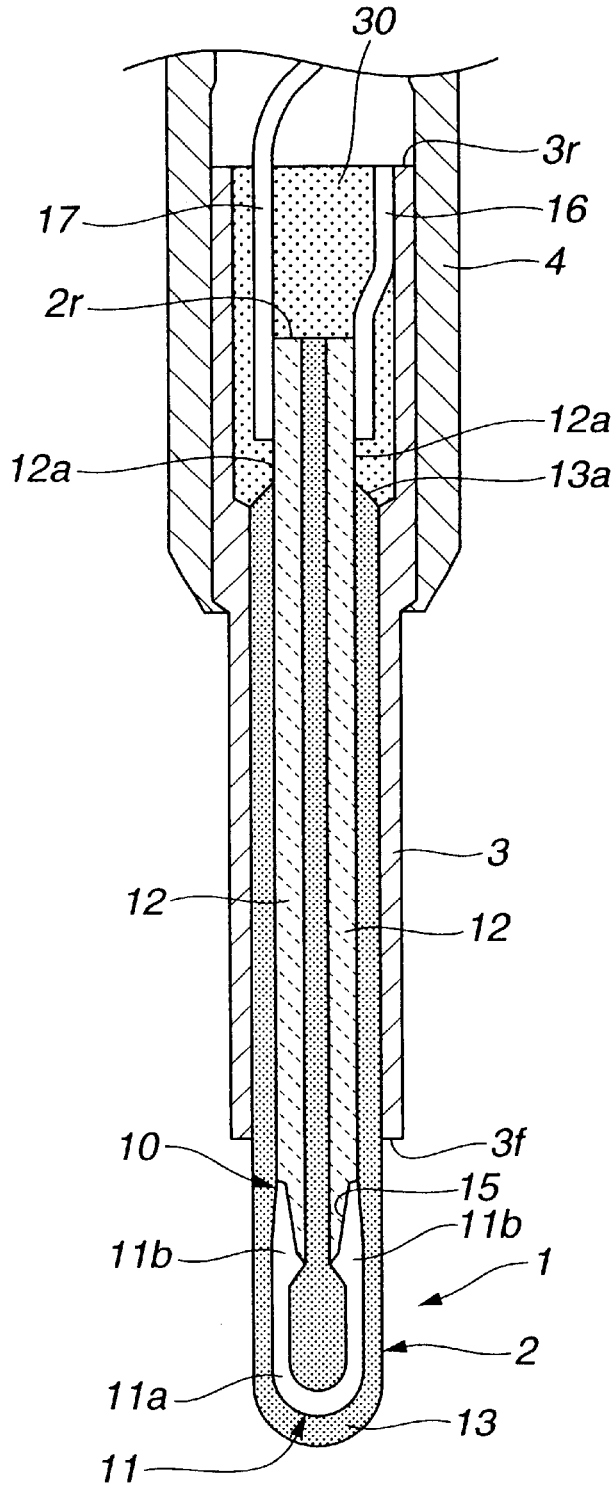
FIG. 3 is a sectional view of a front end portion of the heater of FIG. 1.

As shown in FIGS. 1, 2B and 3, the glow plug 50 has a ceramic heater 1 including a rod-shaped heater body 2, a metallic sleeve 3 circumferentially surrounding the ceramic heater 1 with a front end portion of the heater body 2 protruded from a front end face 3*f* of the metallic sleeve 3, a cylindrical metallic shell 4 fitted onto a rear end portion of the metallic sleeve 3, an electrode 6 disposed in a rear portion of the metallic shell 4 and a terminal 7 having a terminal body 47 integral with the electrode 6 for power supply to the heater body 2 through the electrode 6. A threaded portion 5 is formed on an outer circumferential surface of the metallic shell 4 so as to mount the glow plug 50 in a cylinder head (not shown). The metallic shell 4 is fitted onto the metallic sleeve 3 by brazing (i.e. filling a space between an inner circumferential surface of the metallic shell 4 and an outer circumferential surface of the metallic sleeve 3 with a brazing material) or by laser welding an inner front edge of the metallic shell 4 to the outer circumferential surface of the metallic sleeve 3.

According to the present invention, the electrode 6 and the terminal body 47 are formed into one piece as a conductive rod 49 and made of e.g. carbon steel or stainless steel.

The electrode 6 is held in a position to provide a space Y between a front end surface 6*f* of the electrode 6 and a rear end surface 2*r* of the heater body 2, and a front end portion of the electrode 6 is electrically connected to a rear end portion of the heater body 2 via a metallic lead wire 17. A ceramic ring 31 is interposed between the inner circumferential surface of the metallic shell 4 and the outer circumferential surface of the rear end portion of the electrode 6 in order for the electrode 6 to be insulated from the metallic shell 4. A protruded head portion 31*a* is formed on the outer circumferential surface of the ceramic ring 31, and retained by a stepped portion 4*e* of the metallic shell 4 so that the ceramic ring 31 does not slip off from the front side. Further, a glass seal layer 32 is formed between the inner circumferential surface of the metallic shell 4 and the outer circumferential surface of the rear end portion of the electrode 6 so as to hold the ceramic ring 31 from the rear side. An outer circumferential portion of the electrode 6 which contacts with the glass seal member 32 is roughened by e.g. knurl processing.

The terminal 7 is protruded from the metallic shell 4 axially toward the rear so as to be capped with a connector 52 with an electrical cable 51 for electrical connection to power source (not shown). Further, the terminal 7 has an engaging portion 48 formed on an outer circumferential surface of the terminal body 47 so that the connector 52 can be detachably fitted onto the terminal 7. More specifically, the engaging portion 48 is formed around the terminal body 47 so as to protrude radially outward. The terminal body 47 and the engaging portion 48 can be separate pieces. In such a case, the terminal body 47 is inserted into the engaging portion 48 so that the engaging portion 48 is retained by a rear end face of the metallic shell 4 via an insulating bushing 8 and thus held in position. Then, the engaging portion 48 is caulked in the direction of an axis of the terminal body 47 and in the direction of the metallic shell 4. This makes it possible to secure the engaging portion 48 to the terminal body 47 and possible to hold the terminal body 47 in position relative to the metallic shell 4 while providing electrical insulation between the terminal body 47 and the metallic shell 4 by means of the insulating bushing 8. Alternately, the terminal body 47 and the engaging portion 48 may be secured to each other by press fitting, or may be adhered to each other using an adhesive. The engaging portion 48 is made of a material, such as low carbon steel, aluminum or resin, which is softer than the material for the electrode 6 and the terminal body 47, so that the engaging portion 48 can be easily formed into any complicated shape for proper engagement of the engaging portion 48 and the connector 52.

As shown in FIG. 2A, the connector 52 has therein a conductive plate 53 connected to the electrical cable 51 and an engaging portion 54 formed on an inner circumferential surface of the connector 52 so as to be engageable with the engaging portion 48. Thus, the connector 52 can be detachably mounted on the terminal 7 upon engagement of the engaging portion 48 and the engaging portion 54. In a state where the connecter 52 is mounted to the terminal 7, the conductive plate 53 comes into contact with the terminal body 47, thereby making an electrical connection between the terminal body 47 and the connector 52 directly.

Figure 5A:
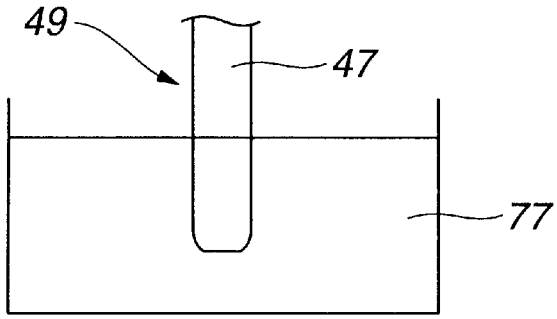
FIGS. 5A and 5B are illustrations showing metal plating process for a terminal of the heater.
Figure 5B:
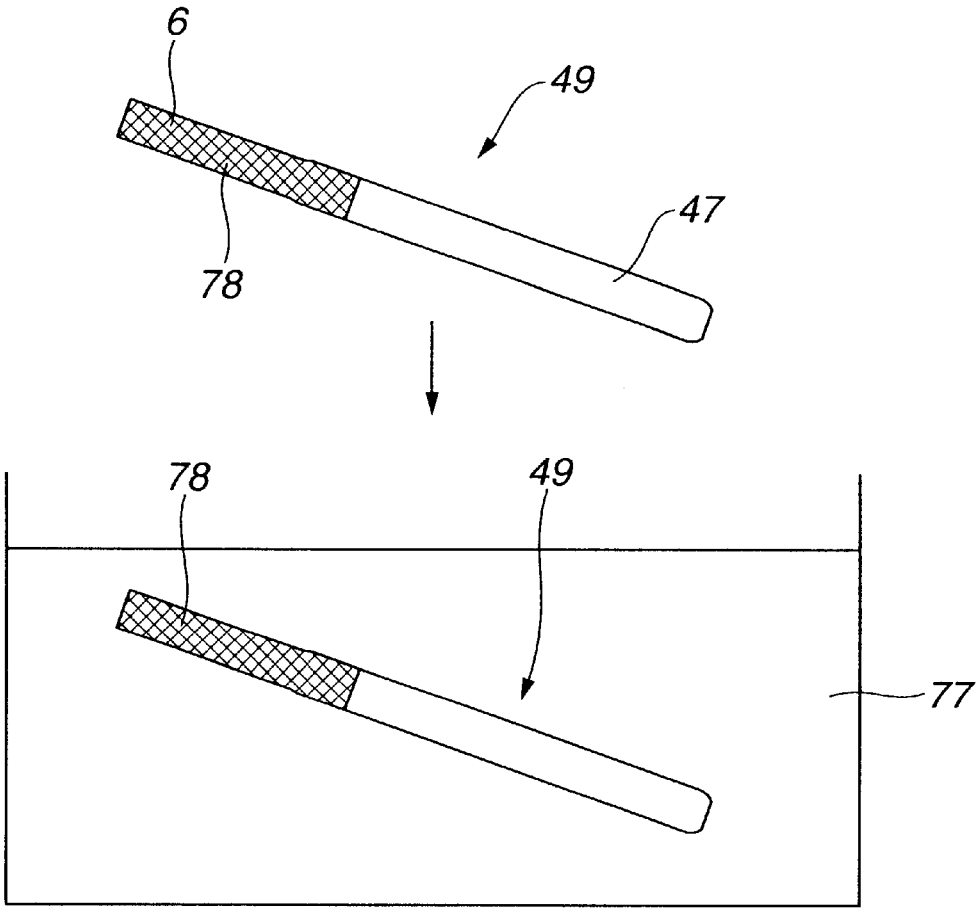

In order to protect the terminal body 47 and the engaging portion 48 from rust, the terminal body 47 is metal plated from a rear end thereof to over a location where the engaging portion 48 is caulked to the terminal body 47. Metal plating is done by dipping the conductive rod 49 into a plating bath 77. In the first embodiment, one part of the conductive rod 49 including a portion where the lead wire 17 is welded to the electrode 6 is not metal plated for good electrical connection between the electrode 6 and the lead wire 17 (hereinafter referred to as "non-plated part"). Herein, the non-plated part may be on the front side of the welded portion of the lead wire 17 to the electrode 6 so as to substantially correspond to the electrode 6 located inside the metallic shell 4. Alternatively, the conductive rod 49 is metal plated from a rear end thereof (i.e. a rear end of the terminal body 47) to a position correspond to a front edge of the glass seal layer 32 which is on the electrode 6, so that the non-plated part extends from the position corresponding to a front edge of the glass seal layer 32 to the front end of the conductive rod 49 (i.e. the front end of the electrode 6). In this case, it is possible not only to prevent the formation of rust but also to ensure electrical insulation between the terminal body 47 and the metallic shell 4 more assuredly, so that the ceramic heater 1 becomes free from the problem of short circuit. There may be used the following method for metal plating: (1) the conductive rod 49 is partly dipped into the plating bath 77 so that a plating coat is formed on the dipped part of the conductive rod 49, and the non-plated part of the conductive rod 49 is kept out of the plating bath 77, as shown in FIG. 5A; or (2) the conductive rod 49 is entirely dipped into the plating bath 77 after a masking film 78 is applied to the non-plated part as shown in FIG. 5B, and then, the masking film 78 is removed afterwards.

As shown in FIG. 3, the heater body 2 is disposed in the metallic sleeve 3 such that the rear end surface 2*r* of the heater body 2 is located on the front side of the rear end face 3*r* of the metallic sleeve 3, and has a ceramic substrate 13 and a heating unit 10 embedded in the ceramic substrate 13. The heating unit 10 is provided with a U-shaped heating resistor 11 embedded in a front end portion of the ceramic substrate 13 and a pair of conductors 12 embedded in the ceramic substrate 13 on the rear side of the heating resistor 11.

The ceramic substrate 13 is made of insulating ceramic. In the first embodiment, silicon nitride ceramic is used. The silicon nitride ceramic contains grains mainly made of silicon nitride ($Si_3N_4$) bonded to each other through grain boundary resulting from a sintering aid. The silicon nitride may contain Al and O with which some of Si and N are substituted, respectively. The grains may contain a metal atom or atoms (such as Li, Ca, Mg and Y) in the silicon nitride as a solid solution.

Both of the heating resistor 11 and the conductors 12 are made of ceramic having electrical conductivity, and the ceramic for the heating resistor 11 (hereinafter referred to as "first ceramic") has a higher electrical resistance than the ceramic for the conductors 12 (referred to as "second ceramic"). More specifically, the first and second ceramic contain the same kind of conductive ceramic material in different contents thereof so as to have distinct electrical resistances. The conductive ceramic material can be any suitable material, such as tungsten carbide (WC), siliconized molybdenum ($MoSi_2$) and siliconized tungsten ($WSi_2$). In the first embodiment, tungsten carbide is used.

The heating resistor 11 has a front end portion 11*a* (i.e. the bottom of U-shape) and rear end portions 11*b* formed with joint faces 15. The front end portion 11*a* is made smaller in diameter than the rear end portions 11*b* so that supply current concentrated at the front end portion 11*a* to heat the front end portion 11*a* to the highest temperature in a state of working.

The conductors 12 are generally in parallel along an axis of the glow plug 50, and have front end portions connected to the respective joint faces 15 of the heating resistor 11 and rear end portions 12*a*. The rear end portions 12*a* of the conductors 12 are protruded from the ceramic substrate 13 and exposed at an outer circumferential surface of the heater body 2. Then, one of the conductors 12 is electrically connected at the rear end portion 12*a* thereof to the front end portion of the terminal electrode 6 via the metallic lead wire 17, and the other of the conductors 12 is electrically connected at the rear end portion 12*a* thereof to the metallic sleeve 3 via a metallic lead wire 16.

In the first embodiment, a front end portion of the lead wire 17 is brazed to the rear end portion 12*a* of the conductor 12, and a rear end portion of the lead wire 17 is joined to the front end portion of the terminal electrode 6 by e.g. resistance welding. The lead wire 16 is formed into a band, so that a front end portion of the lead wire 16 is brazed at one surface thereof to the rear end portion 12*a* of the conductor 12, and a rear end portion of the lead wire 16 is joined at the other surface thereof to the inner circumferential surface of the rear end portion of the metallic sleeve 3 by e.g. brazing or spot welding.

Further, the rear end portion of the metallic sleeve 3, which is from the rear end face 3*r* of the metallic sleeve 3 to a position corresponding to a rear end face 13*a* of the ceramic substrate 13, is filled with glass 30 so as to cover the exposed rear end portions 12*a* of the conductors 12 with the glass 30. As the whole of the lead wire 16 is substantially embedded in the glass 30, the lead wire 16 becomes less likely to cause breaks and poor contact due to vibrations.

In the above-mentioned ceramic heater 1 in which the electrode 6 and the terminal body 47 are formed into a single piece and made of the same material, there is no mechanical connection between the electrode 6 and the terminal body 47. That is, the ceramic heater 1 is kept free of an increase in the resistance to the flow of current, which is generally caused by the formation of rust at the mechanical connection between the electrode 6 and the terminal body 47 and the weakening of the connection between the electrode 6 and the terminal body 47 with the passage of time. It is therefore possible to maintain high electrical conductivity from the connector 52 to the heater body 2 semi-permanently. Further, there is no need to caulk the terminal 7 to the electrode 6 or to screw the terminal 7 onto the electrode 6. The conductive rod 49 can be thus produced without knurling the terminal body 47 so as to strengthen the connection between the electrode 6 and the terminal body 47 or cutting threads in the electrode 6 and the terminal body 47, thereby reducing the production cost of the conductive rod 49. Furthermore, the terminal 7 is capped with the connector 52 by engagement of the engaging portions 48 and 54 so as to make an electrical connection between the terminal body 47 and the conductive plate 53 of the connector 52 directly. This makes it possible to ensure the electrical connection between the terminal body 47 and the conductive plate 53 of the connector 52 more assuredly than would be made through e.g. the engaging portion 48 formed separately from the terminal body 47, and at the same time, possible to attain the electrical connection between the terminal body 47 and the conductive plate 53 and the mechanical connection between the engaging portions 48 and 54 under the respective optimum conditions.

When a plurality of ceramic heaters 1 are used for one device (such as a multivalve engine), the ceramic heaters 1 are brought into engagement with the respective connectors 52. Thus, the performance of each ceramic heater 1 can be easily tested by picking up a test signal from the corresponding connector 52. It is thus possible to perform what is called on-board diagnosis (OBD) for automatic performance testing on each ceramic heater 1 by the use of a microcomputer Next, a sheath heater 101 according to a second embodiment of the present invention will be described with reference to FIG. 4. The second embodiment is similar in structure to the first embodiment unless otherwise specified below.

Figure 4:
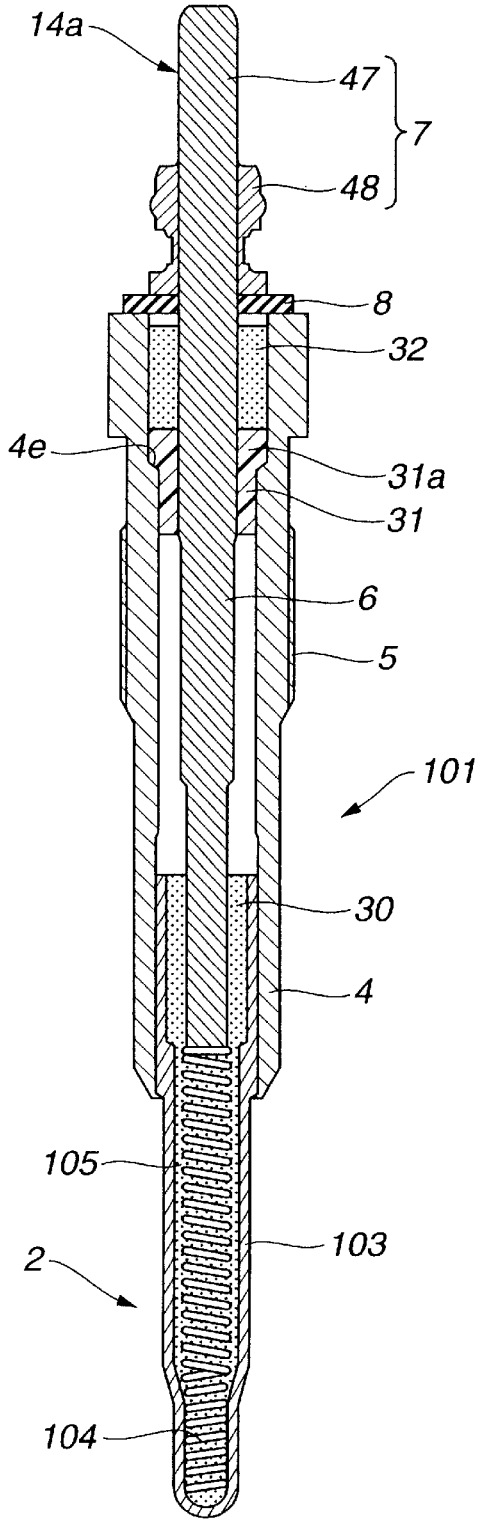
FIG. 4 is a sectional view of a heater embodied as a sheath heater according to a second embodiment of the present invention.

As shown in FIG. 4, the sheath heater 101 has a metallic shell 4 made of e.g. carbon steel, a heat-resistant metallic sheath tube 103 made of e.g. stainless and retained in a front end portion of the metallic shell 4, a heater body 2 having a heating coil 104 disposed coaxially in the sheath tube 103, an electrode 6 inserted in a rear portion of the metallic shell 4 and a terminal 7 having a terminal body 47 integral with the electrode 6 for power supply to the heating coil 104 through the electrode 6.

A front end of the sheath tube 103 is spherically closed, and a rear end of the sheath tube 103 is open so that a front end portion of the electrode 6 is coaxially inserted into the sheath tube 103. Further, the sheath tube 103 is filled with electric insulating powder 105 so as to retain the heating coil 104. The heating coil 104 is electrically connected at a rear end portion thereof to the electrode 6 and, at the same time, electrically connected at a front end portion thereof to the sheath tube 103.

The electrode 6 and the terminal body 47 are formed into one piece as a conductive rod 149. The conductive rod 149 is structurally the same as the conductive rod 49. A connector 52 with an electrical cable 51 is mounted on the terminal 7 upon engagement of an engaging portion 48 of the terminal 7 and an engagement portion 54 of the connector 52 (not shown in FIG. 4) so as to make an electrical connection between the terminal body 47 and a conductive portion 53 of the connector 52 (not shown in FIG. 4) directly for power supply to the heating coil 104.

In such a sheath heater 101, there is no mechanical connection between the electrode 6 and the terminal body 47. That is, the sheath heater 101 kept free of an increase in the resistance to the flow of current, which is generally caused by the formation of rust at the mechanical connection between the electrode 6 and the terminal body 47 and the weakening of the connection with the passage of time. It is therefore possible to maintain high electrical conductivity from the connector 52 to the heating coil 104 semi-permanently. Herein, the sheath heater 101 can be applied to e.g. an engine-coolant heating device, a heat source for heating a small amount of water in a short time (such as a compact calorifier, a toilet washer or a wash-hand water heating appliance) and a glow plug.

Although the present invention has been described with reference to specific embodiments of the invention, the invention is not limited to the above-described embodiments. Various modification and variation of the embodiments described above will occur to those skilled in the art in light of the above teaching. The scope of the invention is defined with reference to the following claims.

What is claimed is:

1. A heater assembly comprising:

a heater having:

a cylindrical metallic shell;

a heater body partly disposed in a front end portion of the metallic shell;

an electrode disposed in a rear portion of the metallic shell and electrically connected to the heater body; and a terminal having a body and a first engaging portion formed on an outer circumferential surface of the terminal body, wherein the first engaging portion is made of a material softer than a material that the electrode and the terminal are made of; and an electric connector having a second engaging portion formed on an inner circumferential surface thereof so as to be engageable with the first engaging portion, said electric connector including therein a conductive plate and a cable connected to the conductive plate for making electrical connection with the terminal body for power supply to the heater body through the electrode, the electrode and the terminal body being formed integrally with each other, the first engaging portion being formed into a radially outward protrusion, and the terminal body and the first engaging portion being separate pieces.

2. A heater assembly according to claim 1, wherein the material of the electrode and the terminal body is selected from the group consisting of carbon steel and stainless steel, and the material of the first engaging portion is selected from the group consisting of low carbon steel, aluminum and resin.

3. A heater assembly according to claim 1, wherein the first engaging portion is caulked to the terminal body.

4. A heater assembly according to claim 1, wherein the first engaging portion is provided around the terminal body and retained by a rear end face of the metallic shell via a ring-shaped insulating member.

5. A heater assembly according to claim 1, wherein the terminal body is metal plated from a rear end thereof to over a location where the first engaging portion is formed.

6. A heater assembly according to claim 1, wherein the electrode and the terminal body are held in position by means of a glass seal layer interposed between an inner circumferential surface of the metallic shell and an outer circumferential surface of a rear end portion of the electrode, and metal plating is formed from a rear end of the terminal body to a position on the electrode corresponding to a front edge of the glass seal layer.

* * * * *